United States Patent [19]

Gradert

[11] 4,088,304

[45] May 9, 1978

[54] WINCH SYSTEM CONTROL MECHANISM FOR THE SIMULTANEOUS CONTROL OF TWO WINCH MOTORS

[75] Inventor: Arno Gradert, Bad Segeberg, Germany

[73] Assignee: O & K Orenstein & Koppel Aktiengesellschaft, Germany

[21] Appl. No.: 660,154

[22] Filed: Feb. 23, 1976

[30] Foreign Application Priority Data

Feb. 25, 1975 Germany ..... 2507947

[51] Int. Cl.[2] ..... B66D 1/26

[52] U.S. Cl. ..... 254/184; 60/905

[58] Field of Search ..... 254/150 FH, 172, 173, 254/183, 184; 60/905; 91/413, 170 R

[56] References Cited

U.S. PATENT DOCUMENTS

| | | | |
|---|---|---|---|
| 3,435,616 | 4/1969 | Waldorff | 254/150 FH |
| 3,510,107 | 5/1970 | Fidler | 254/184 X |
| 3,643,922 | 2/1972 | Van Der Linde | 254/184 |
| 3,972,185 | 8/1976 | Medina | 60/905 X |

*Primary Examiner*—Drayton E. Hoffman
*Assistant Examiner*—Donald W. Underwood
*Attorney, Agent, or Firm*—McGlew and Tuttle

[57] ABSTRACT

A winch system control mechanism for the simultaneous control of two winch motors includes a servo valve which is connected to an adjustable cylinder double drive pump for regulating the fluid pressure delivered from the pump to a winch motor driving a respective winch drum over which the respective cable or rope is engaged. A control means in the form of a shiftable hand lever is movable on either side of a neutral position in order to effect a heaving of the drum or a veering of the drum by regulating the position of the servo valve. The arrangement includes a control mechanism connected between the control means for the servo valve of each of the winch motors which operates to permit a varying of the driving pressure fluid which acts on the drum in accordance with the heaving or veering pressure produced on the associated winch drum by the action of the cable or line so that the fluid pressure acting on a first winch motor is controlled as a function of the tension of the rope on the other winch drum causing a reverse rotation of this drum and a build up of the pressure in the system which effects a change in the heaving operation of the first drum.

7 Claims, 1 Drawing Figure

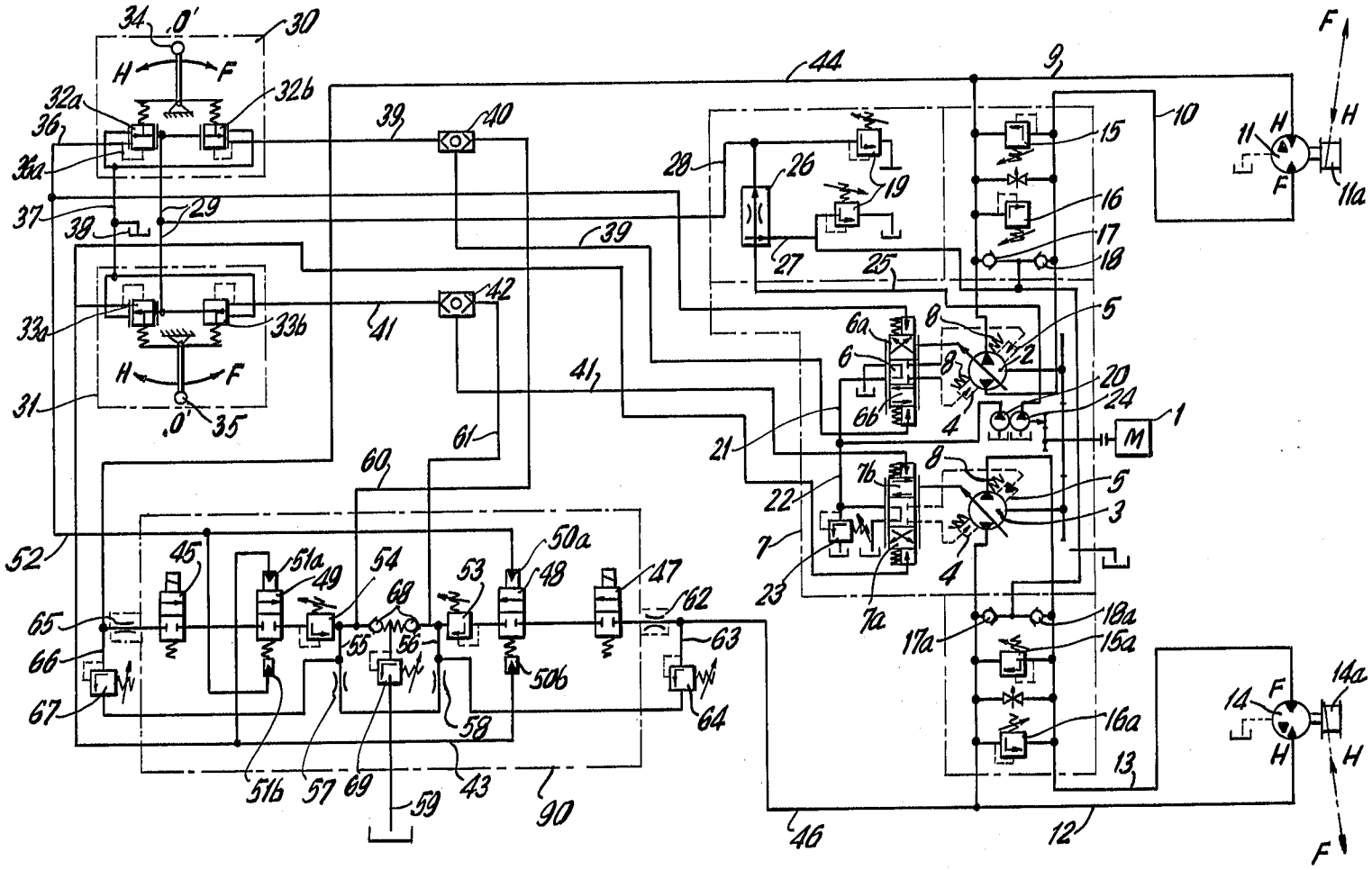

WINCH SYSTEM CONTROL MECHANISM FOR THE SIMULTANEOUS CONTROL OF TWO WINCH MOTORS

BACKGROUND OF THE INVENTION

1. Field of the Invention

This invention relates in general to the construction of winches and in particular to a new and useful winch system which includes means for the compound control of two separate winch motors so that the tensions on their respective heaving lines may be correspondingly regulated.

2. Description of the Prior Art

The present invention relates to a control device for two winch motors for compound drives, which are connected, each through a high pressure and a low pressure line, in a closed circuit comprising a hydrostatic, continuously adjustable, drive pump which is controlled through a continuously adjustable servo valve. There are known control devices of this kind in which, during the windup of one of the ropes or cables, the operator has to control the winch motor by means of a manual adjusting mechanism while observing the tension of the ropes. The other winch, having to pay out the other rope correspondingly, thereby drives its motor which, now, acts as a pump. The delivered oil volume drains through a brake valve of large diameter. This means that a great quantity of energy is converted into heat and large oil coolers are needed. Also, the wear is unnecessarily high. In addition, with unfavorable turns ratios of the rope drums and an open circuitry, there is a risk of overspeeding the winch motors, with still more heat generation or even destruction of a motor by excess speed.

SUMMARY OF THE INVENTION

The present invention is directed to a control device in which such drawbacks are eliminated and the operation of the winch motors is optimized for any of the various occurring conditions. The rope tension of the veering winch has to be controlled with the maximum possible continuousness and maintained with the smallest possible losses. Further, automatically, i.e. without a particular attention on the part of the operator, the rope tension of the veering winch must not exceed a predetermined or adjusted value, while the other winch is heaving. The maximumload limiting means in the high-pressure lines of the winch motors have to operate with smallest possible losses. All these desired advantages have to be achieved, particularly in a compound control, with a closed, low-loss, hydrostatic, compound circuitry.

In accordance with the invention, a circuitry is provided making it possible that for veering with a first winch motor while heaving with the second one, a continuously adjustable drive pump connected in the high pressure line of the first winch motor is controlled, as a function of the rope tension, by the pressure which is produced by the rope tension in the high pressure line of the first winch motor.

The invention has the advantage that the control device can be very simply attended to along with the compound drive and that overloads and, therefore, also wear and excessive power consumption during operation of the winches, are avoided. The rope tension of the veering winch does not exceed a predetermined value during the heaving of the other rope, and, at the same time, the rope tension of the veering winch is adjustable. A permanent overload of the drive pumps is prevented.

The inventive control device may be designed differently. The control device may operate hydraulically but it may also be designed as an electrically operated device.

In a simple embodiment of the invention, for hydraulic operation, a control space is connected to each control line for heaving of the respective one of the motors, which control space is intended for opening a stop valve closing a line leading from the high pressure line of the other winch motor to an aperture means, and upstream of each of the aperture means, a line is branched off leading to a shuttle valve which is connected in the control line for veering of the other winch motor.

The control device is simple in design and uses only some few constructional elements. It works reliably no particular control circuitry.

To be able to control the rope tension of the veering winch, adjustable pressure relief valves are provided in the lines leading to the aperture means, permitting the control of the oil pressure produced upstream of the aperture means and, thereby, the corresponding control pressure acting on the servo valves.

According to a development of the invention, each control space for opening one of the stop valves can be connected to the control space for closing the other stop valve.

To prevent possible overloads in the control lines upon an excessive increase in pressure, the lines may be connected, upstream of the aperture means and through a common check valve, to a relief line.

In order to prevent the control device from being exposed to an excessive quantity of control oil, a further development of the invention provides that an aperture means may be connected in each of the lines branched off the high pressure lines. Such aperture means, in addition, due to the limitation of the oil volume flowing therethrough, prevent pressure shocks and pressure oscillations from passing into the control line.

Further, to obtain a general maximum-load limitation, upstream of each of the aperture means, a line may be branched off leading, through a pressure-limiting valve, to the respective one of the lines connected upstream of the aperture means.

To be able to disconnect the control device, for example, in cases where the winch motors are to be operated individually, stop valves for putting the device out of operation may be connected in the lines leading to the aperture means. The stop valves may be operated electrically.

A simple embodiment of the invention for electrical operation comprises pressure measuring members for electrically controlling the respective veering winch motor, which are connected in the high pressure lines of the winch motors.

Accordingly it is an object of the invention to provide a winch system which comprises first and second fluid operated winch motors each having a respective first and second rope drum over which a rope is engaged and which includes a servo valve control for varying the output of a variable output fluid drive pump connected to the winch motor in accordance with the position of a control mechanism between a maximum heaving position to a neutral and to a veering position for rotation in opposite directions and with a control in the system for providing control of the first motor by the veering or heaving of the second motor and vice versa through the hydraulic control system.

A further object of the invention is to provide a winching system which is simple in design, rugged in construction and economical to manufacture.

BRIEF DESCRIPTION OF THE DRAWING

The only FIGURE of the drawing is a schematic representation of a winch system constructed in accordance with the invention.

GENERAL DESCRIPTION OF THE PREFERRED EMBODIMENTS

A drive motor 1 drives a double-drive pump 2, 3 which is designed as a hydrostatic variable-delivery pump for a closed circuit and comprises two adjustable axial-piston pumps having cylinders which are adjustable in a well known manner. This makes it possible to continuously adjust the delivery of these pumps.

The adjusting mechanic comprises, for each pump, two adjusting cylinders 4 and 5 which are connected, through respective lines, to continuously adjustable servo valves 6 and 7. In a well known manner, the adjusting cylinders 4 and 5 are equipped with return springs 8.

From drive pump 2, a high pressure line 9 and a low pressure line 10 lead to a port side rope or cable winch motor 11 driving a rope or cable drum 11a, while from pump 3, a high pressure line 12 and a low pressure line 13 lead to a starboard cable winch motor 14 driving a cable drum **14*a***. By a high pressure line, as usual, the line is understood through which the oil flows to the motor during the heaving or winch operation.

Between high pressure line 9 and low pressure line 10, two pressure relief valves 15 and 16 are provided in a manner known per se through which, depending on the pressure direction, an overpressure passes from the respective high pressure line to the low pressure line. Also between high pressure line 9 and low pressure line 10, check valves 17, 18 are provided whose outlet lines are led back to the closed circuit. The outlet lines of check valves 17, 18 are connected to usual controls 19 which are not described in detail. Similar elements, such as pressure relief valves **15*a*, 16*a* and check valves 17*a*, 18*a*, are provided between high pressure line 12 and low pressure line 13**.

Drive motor 1 further drives a gear pump 20 by which control lines 21 and 22 are supplied. The control lines lead through servo valves 6 and 7, to adjusting cylinders 4 and 5. Also connected to control lines 21, 22 is a pressure relief valve 23 preventing an excessive increase in pressure. The control circuit is an open circuit.

Drive motor 1 also drives another gear pump 24 supplying oil both to the pilot control circuit and to the feed oil circuit. From this gear pump 24, a line 25 leads to a volume divider 26 wherefrom one line 27 leads to the controls 19 and another line 28 leads to the oil inlet lines 29 of two hand controls 30 and 31. Pressure reducing valves **32*a* and 32*b* as well as 33*a* and 33*b* are connected to the oil inlet line 29 and they are actuated by control levers 34 and 35. The control direction for heaving is designated "H" and the control direction for veering "F". In the normal position "O", pressure reducing valves 32*a, b* and 33*a, b*** are closed.

Upon actuation of control lever 34 for heaving, pressure reducing valve **32*a* establishes connection between oil inlet line 29 and control line 36. The pressurized oil actuates servo valve 6 so that this valve is switched into its cross position 6*a*. Due to the applied control pressure, adjusting cylinder 5 and, thereby, drive pump 2 is adjusted. The pump delivers oil to port side rope winch motor 11. The rope of rope drum 11*a* is heaved. If, to the contrary, control lever 34 is moved in the direction of arrow "F", initially, the flow of control oil into control line 36 is stopped. The pressure further acts, through line 36*a*, on the movable valve part of pressure reducing valve 32*a* and thrusts the same into a position in which the oil can flow from control line 36*a* through line 37 to a tank 38. Control line 36 becomes pressureless. Under the action of its spring, servo valve 6 returns into its initial shown position. Adjusting cylinder 5 becomes pressureless and is returned to its zero position by return spring 8 so that now, port side rope winch motor 11** is also stopped.

The oil supply to the port side rope motor 11 is shut off. Pressure reducing valves **32*b*, 33*a*, and 33*b*** are identical in design.

Upon further traversing control lever 34 in the direction of arrow "F", pressure reducing valve **32*b* is adjusted so that now control oil is supplied, through a shuttle valve 40 which will be described hereinafter, into control line 39. Servo valve 6 is thereby shifted into its parallel position 6*b* and the oil acts now on adjusting cylinder 4. In consequence, drive pump 3 drives port side winch motor 11** in the opposite direction.

The operation with control lever 35 serving to control starboard rope winch motor 14, is analogous. Here again a shuttle valve 42 to be described later, is connected in control line 41 which leads from pressure reducing valve **33*b* to servo valve 7**.

For facilitating the control of the two winches and preventing excessive power consumption, a control device generally designated 90 is connected in the circuit, in accordance with the invention.

A line 44 leading to an electrically controlled stop valve 45 is branched off high pressure line 9 of port side winch motor 11. A line 46 leads from high pressure line 12 to an electrically controlled stop valve 47. As long as both stop valves 45 and 47 are in closed position, the control device 90 is out of action. Further stop valves 48 and 49, actuable by control pistons from both sides, are connected in lines 44 and 46, downstream of stop valves 45 and 47. The pistons operate in control spaces **50*a*, 50*b*, 51*a* and 51*b*, respectively. Control spaces 50*a* and 51*b* are connected to control line 52 of pressure reducing valve 32*a*. Control spaces 51*a* and 50*b* are connected to control line 43 of pressure reducing valve 33*a***.

A pressure relief valve 53 is connected to the outlet side of stop valve 48 and a pressure relief valve 54 is connected to the outlet side of stop valve 49. The outlets of both pressure relief valves 53, 54 lead, through lines 55, 56 and aperture means 57, 58, to a relief line 59.

Upstream of aperture means 57, 58 the shuttle valves 40, 42 are connected to lines 55, 56, through lines 60 and 61.

In the line 46 leading to the electrically controlled stop valve 47, an aperture means 62 is connected. A line 63 leading through a pressure limiting valve 64 to line 56 is branched off line 46. In a similar manner, an aperture means 65 is connected in line 44, upstream of the electrically controlled stop valve 45. A line 66 is branched off line 44 and leads through a pressure limiting valve 67 to line 55.

The device operates as follows: It is assumed that both ropes are held in a certain tension as, for example, in the case of working with a pontoon which is fixed by ropes.

As the control device 90 is switched on, the two stop valves 45 and 47 are opened so that the two lines 44 and 45 are connected for compound operation. If, for example, control handle 34 is brought into the "heaving" position 11, the control oil effects the adjustment of drive pump 2 in the manner described above. Port side winch motor 11 drives its rope drum 11*a*.

The working vessel is moved until the rope is stretched. Now, the rope connected to rope drum 14*a* is also stretched. Starboard winch motor 14, however, cannot turn. But it acts as a forcing pump and produces an increasing pressure in lines 12 and 46. High pressure line 12 is shut off by the not yet adjusted drive pump 3. On the other hand, by the pressure in the line connected to control line 36, stop valve 48 is opened so that now oil from line 46 can flow through pressure relief valve 53 to relief line 59. Thereby, pressure is increased upstream of aperture means 58 and this pressure acts, through line 61 and shuttle valve 42 in control line 41, on servo valve 7. This valve is switched into position 7*b* so that now drive pump 3 is adjusted for driving starboard winch motor 14 in the veering direction. Thus, merely by actuating the single control lever 34 and bringing it into a corresponding position, the steersman can obtain a smooth motion of the working vessel and a continuous adjustment of this motion with the ropes permanently stretched by force closure.

For securing the adjustment, the device may be provided in addition with two check valves in lines 55 and 56 which, in the present example, are represented as a united check valve 68. Check valve 68 is connected to relief line 59 through a pressure relief valve 69. An aperture means 65 connected in line 44 and another aperture means 62 connected in line 46 serve for limiting the volume of control oil and they also function to minimize the oil volume necessary for the operation of the device. Due to the limitation of the oil flow, they also serve to prevent or compensate for pressure shocks or pressure oscillations in the oil line and, thus, have a damping effect.

The inventive device is further intended as a limiter of the maximum load. If, as a result of an excessive pull in the ropes driven by the winch motors, the pressure in the two high pressure lines 9 or 12 exceeds a predetermined value, the respective one of the two pressure limiting valves 64 or 67, having a small nominal bore, opens. A relatively small oil volume flows through aperture means 57 or 58 and relief line 59 to the tank. The pressure upstream of the aperture means increases so that oil flows through lines 60 or 61 and shuttle valves 40, 42.

Let it be assumed hand lever 34 is set to heaving and oil flows through control line 39 and shuttle valve 40 to servo valve 6 which is continuously adjustable. Continuously adjustable servo valve 6 adjusts to its end position depending on the difference between the pressure in control line 36 and the counterpressure in control line 39. Thereby drive pump 2 is adjusted back relative to its preselected position so that its rate of flow drops. Consequently, less oil is supplied to port side winch motor 11 and an overload of this motor and rope drum 11*a* is prevented, with the advantage that pressure relief valve 16 no longer opens. A short circuit circulation of the working oil, converting mechanical energy into heat, is prevented. In consequence, the steersman can never inadvertently adjust an energy consuming loading of the rope winches. The remaining function of pressure relief valves 15, 15*a*, 16, 16*a* is only to reduce temporary overloads (pressure peaks) prior to the response of the control.

The inventive device may be operated also in a manner such that even with a preselected compound operation, each winch can be operated separately, without having to disengage the compound drive.

In such a case, the device operates as follows:

Assume that both ropes are just working in a certain position in compound operation, for example, the vessel is to be warped to port. By presetting control lever 34 to "heaving", pressure relief valve 32*a* is actuated and the way for the control oil through line 36 to servo valve 6 is cleared. The building up pressure switches servo valve 6 into position 6*a* whereby pump 2 is actuated and the delivery thereof drives port winch motor 11. Simultaneously, through control lines 36 and 52, stop valve 48 is opened, while stop valve 49 remains closed and additional pressure is applied to control space 51*b*.

Due to the circuitry of compound operation, the starboard winch now veers the rope under initial tension, as already explained.

1. If now, for any reasons of dredging which need not be explained in detail, the starboard winch has to veer quicker, the steersman has to switch control lever 35 additionally to "veering". Then, in shuttle valve 42, the higher pressure in control line 41 superimposes upon the pressure in control line 61, with the result that pump 3 is displaced more and the starboard winch veers faster. As soon as control lever is brought back into its zero position, the starboard winch readjusts again to the preselected tension of the rope.

2. Should the starboard winch, for other reasons of dredging, be switched from "veering" to "heaving", the steersman has to throw control lever 35 to "heaving" whereupon pressure reducing valve 33*a* allows control oil to flow, through control line 41, to serve valve 7 and the building up pressure switches the servo valve into position 7*a;* at the same time, through control line 43, control space 50*b* is pressurized whereby stop valve 48 is closed. Drive pump 3 is now displaced in the opposite direction so that starboard winch motor 14 rotates also in the heaving direction, without having the compound system disconnected. Upon returning control lever 35 into its zero position, the starboard winch again adjusts automatically to the preselected tension of the rope.

While specific embodiments of the invention have been shown and described in detail to illustrate the application of the principles of the invention, it will be understood that the invention may be embodied otherwise without departing from such principles.

What is claimed is:

1. A winch control system for two winch motors, comprising first and second fluid-operated winch motors each having respective first and second rope drums, a rope engaged over each of said first and second rope drums maintained in tension therebetween and being paid out by one of said motors when the other of said motors is winding said rope up on the associated drum, a first adjustable cylinder fluid drive pump connected to said first winch motor, a second adjustable cylinder fluid drive pump connected to said second winch motor, a first servo valve connected to said first adjustable cylinder fluid drive pump and being continuously adjustable to vary the output of said first drive pump, a second servo valve connected to said second adjustable cylinder fluid drive pump and being continuously adjustable to vary the output of said second adjustable cylinder drive pump, conduit means interconnecting said first and second cylinder drive pumps and said first and second winch motors in a closed circuit including a first control connected to said first servo valve for varying the pressure acting on respective ends of said servo valve to cause said first adjustable cylinder to be varied selectively to deliver fluid pressure to drive said first winch motor and to relieve such fluid pressure and to permit reversal of said drive motor, a second control connected to said second servo valve for varying the pressure acting on respective ends of said second servo valve to cause said second servo valve to regulate said second adjustable cylinder fluid drive pump to be varied selectively to deliver fluid pressure to drive said second winch motor into relief pressure and to permit reversal of said second winch motor, and a control device in said conduit means connected between said first and second controls and said first and second servo valves for varying the driving pressure fluid acting on one of said first and second winch motors inversely in respect to the other of said winch motors in accordance with the pressure acting on the drum of the other of said first and second winches and the associated winch motor, said control device including a control line in the connection between said first and second controls and said first and second servo valves having a control space (50*a*, 51*a*) for opening a stop valve (48, 49) each of said first and second adjustable cylinder fluid drive pumps being connected to the associated winch motor through a respective first and second high pressure line, said stop valve being in a line leading from said high pressure line having aperture means (57, 58), a branch line (60, 61) connected upstream of said aperture means having a shuttle valve (40, 42), and a control line connected to each of said winch motors and to said shuttle valve for the veering operation of one winch motor in response to the tension of the other motor.

2. A winching system according to claim 1, wherein each control space (50*a*, 51*a*) for opening one of the stop valves (48, 49) is connected to the respective control space (50*b*, 51*b*) for closing the other of said stop valves (48, 49).

3. A winching system according to claim 2, wherein the upstream of the aperture means (57, 58), the lines (55, 56) are connected, through a common check valve (68) to a relief line (69).

4. A winching system according to claim 3, wherein an aperture means (62, 65) is connected in each of the lines (44, 46) which are branched off the high pressure lines (9, 12).

5. A winching system according to claim 4, wherein an upstream of each of the aperture means (62, 65), a line (63, 66) is branched off leading, through a pressure-limiting valve (64, 67), to the respective line (55, 56) upstream of the aperture means (57, 58).

6. A winching system according to claim 5, wherein additional stop valves (45, 47) are connected in the lines (44, 46) leading to the aperture means (57, 58).

7. A winching system according to claim 1, wherein in the high pressure line (9, 12) of the winch motors (11, 14), pressure measuring members for an electrical control of the respective veering winch motor (11, 14) are connected.

* * * * *